United States Patent [19]

Montoya

[11] Patent Number: 4,846,100

[45] Date of Patent: Jul. 11, 1989

[54] FOLDABLE PAINT SPLATTER BOARD HAVING A COLLAPSIBLE PAINT VESSEL HOLDER

[76] Inventor: Esequiel E. Montoya, 4728 Brenda, NE., Albuquerque, N. Mex. 87109

[21] Appl. No.: 203,687

[22] Filed: Jun. 7, 1988

[51] Int. Cl.[4] ..... B05C 11/10

[52] U.S. Cl. ..... 118/504; 206/216

[58] Field of Search ..... 118/501, 504, 505, 506, 118/301; 206/216, 477, 475; 15/257.05, 257.06

[56] References Cited

U.S. PATENT DOCUMENTS

| | | | |
|---|---|---|---|
| 2,705,555 | 4/1955 | Brenner | 206/216 |
| 2,853,185 | 9/1958 | Guyer | 206/216 |
| 2,905,371 | 9/1959 | Huff | 15/257.06 |
| 3,423,059 | 1/1969 | Kahn | 206/478 |
| 3,429,296 | 2/1969 | Legere | 118/504 |
| 3,565,038 | 2/1971 | Van Barriger | 118/504 |
| 3,788,274 | 1/1974 | McNaughton et al. | 118/504 |
| 4,033,489 | 7/1977 | Fowler | 206/216 |
| 4,325,323 | 4/1982 | Rioux | 118/504 |
| 4,331,716 | 5/1982 | Stark | 118/504 |
| 4,566,590 | 1/1986 | Manning | 206/216 |

*Primary Examiner*—Willard Hoag

*Attorney, Agent, or Firm*—Deborah A. Peacock; Robert W. Weig

[57] ABSTRACT

A foldable paint splatter board with collapsible paint vessel holder. The apparatus is foldable for storage and the vessel holder thereof erects and collapses, as needed. Boundary marking indicia are provided to alert a user to the edges of the safe painting region. The device is inexpensive enough to be considered disposable and can be constructed from corrugated paperboard, cardboard and the like. Paint trays and paint cans can be held by the vessel holder.

23 Claims, 2 Drawing Sheets

FOLDABLE PAINT SPLATTER BOARD HAVING A COLLAPSIBLE PAINT VESSEL HOLDER

FIELD OF THE INVENTION

The invention relates to protection from paint splatter and paint vessel retainage and more particular to foldable paint splatter boards having paint vessel holders thereon.

BACKGROUND OF THE INVENTION

Professional painters and do-it-yourselfers splatter paint when painting with rollers and paint brushes. Thus, when painting a wall, a painter must protect the floor and/or its covering, such as carpet, tile, and the like, from paint which would inevitably splatter thereon if the floor surface was left unprotected. Cleaning splattered paint off hardwood and tile is difficult, but removing it from carpets and rugs is almost impossible, especially if the carpet or rug is hoped to be left undamaged by the cleaning fluid. Clearly, and as is well known, protecting such surfaces from spattering paint is highly preferred to cleaning paint splatters from them.

Various devices and surface covers have been used. Old newspapers, broken down cardboard boxes, tarps, and the like are frequently available. Such materials have relatively straight edges so that they fit well against walls. However, newspapers slip when walked on and splattered paint on the paper will adhere to the sole of a user's shoe when stepped on. When the shoe is raised, the newspaper tears. Collapsed cardboard and corrugated paperboard boxes have slots where the boards fold to form their bottoms and tops. Paint can splatter through these slots. Too, frequently, sheets of paper shift relative to one another when walked upon, especially from splatters adhering to shoe soles. Tarps are expensive, difficult to clean and do not stay against the wall.

Another problem is that of retaining a paint tray or paint can in position. In the course of painting a wall, a painter is frequently looking up and away from the paint container which is usually left on the floor. The paint container is sometimes kicked over or at least kicked hard enough to cause spillage over its side due to an abrupt lateral movement of the container. Too, the paint vessel at times sticks to the paper it splatters under it or from paint running down its sides. When the painter attempts to move the vessel, if it is on newspaper, the paper many times will tear and paint will get on the floor surface the painter is attempting to protect.

These problems have been recognized and attempts have been made to solve them. U.S. Pat. No. 4,325,323 to Rioux describes a collapsible paint tray carrier and paint splatter protector mounted on casters and having slidable drawer-like side extending panels. A paint tray can be clamped to the central panel of the device. This device is clearly more expensive than newspapers, cardboard or corrugated paperboard. The device, being on casters, positions its protective panels above the surface of the floor and not immediately on it. Only a paint tray can be held on the device and it must be fastened using a clamp and bolts. No indicia are displayed on the device to indicate to a user the boundaries for effective splatter protection offered by the device. Too, the side panels, because they are boxed under the central panel, cannot abut the wall, and leave a space for paint splatter to occur immediately adjacent the wall being painted. On walls having high moldings, the molding cannot be protected with this device. Any accessory device, such as disclosed in U.S. Pat. Nos. 3,788,274 to McNaughton et al, 3,565,038 to Van Barriger, and 3,429,296 to Legere, which describe tools for covering a molding, can not readily be used since the central panel is substantially higher than the end panels. Such molding protectors can be easily used with the instant invention.

SUMMARY OF THE INVENTION

In accordance with the present invention there is provided a foldable paint splatter board with collapsible paint vessel holder comprising covering structure for protecting a surface from paint splatter, the covering structure comprising an at least semi-rigid surface covering and protecting element. The element comprises an edge engageable with the base of a vertical structure to be painted. The element is foldable on at least one preselected seam into a relatively more compact configuration when not in use. The apparatus also comprises a holder disposed on the element for retaining a paint vessel thereon. The element is preferably foldable on at least two selected seams and the vertical structure engaging edge is preferably essentially straight to engage the base of a wall. The surface protecting covering structure preferably has spaced boundary marking indicia thereon. The spaced indicia are viewable by a user, and positioned on the covering to establish safe painting boundaries to alert a user to confine painting to above the region between the spaced indicia whereby covering structure, with a high probability, will protect the surface covered thereby from splatter. In the preferred embodiment the indicia comprise stripes extending substantially perpendicular from the wall engaging edge. In the preferred embodiment the element is essentially rectangular and the stripes of a contrasting color to the color of the covering structure.

The paint vessel holder can be adapted to hold, for example, a paint tray or a paint can and is preferably erectable into a raised position for use and collapsible into a flat position for storage. Various shapes and sizes of paint vessels can be held by the paint vessel holder. The holder preferably comprises a generally U-shaped flat element foldable into a U-shaped raised position to provide a U-shaped paint vessel retaining structure, which preferably is adapted for frictionally holding a paint vessel disposed therein. The covering structure can be constructed of, for example corrugated paper, cardboard and the like. The generally U-shaped flat element is preferably foldable into a U-shaped raised position having an inverted-V cross section to provide a U-shaped paint vessel retaining structure. The U-shaped paint vessel retaining structure preferably comprises sufficient springiness, when erected, to frictionally hold the vessel disposed therein.

One object of the present invention is to effectively, but inexpensively, protect floor surfaces from paint splatters.

Another object of the invention is to retain a paint vessel safely in place during use.

One advantage of the present invention is that an apparatus in accordance therewith is sufficiently inexpensive to be disposable after a single use, if desired.

Another advantage of the invention is that painting boundary indicia are provided to alert a user to confine painting to the region therebetween.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and form a part of the specification, illustrate several embodiments of the present invention and, together with the description, serve to explain the principles of the invention. In the drawings.

DETAILED DESCRIPTION OF A PREFERRED EMBODIMENT OF THE INVENTION

Figure 1:
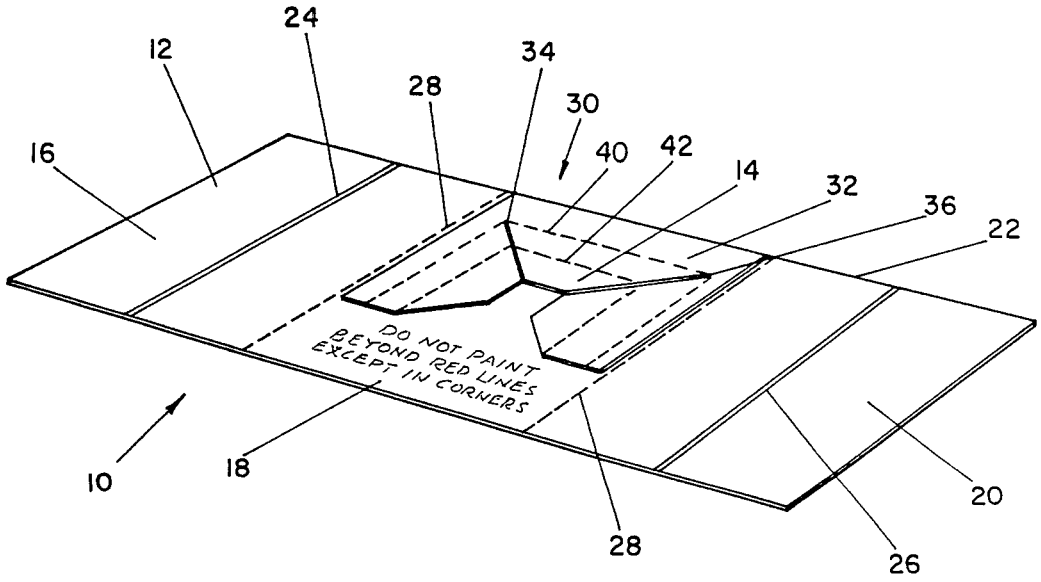
FIG. 1 illustrates a preferred embodiment of the invention in its open for use position with its paint vessel holder collapsed.
Figure 2:
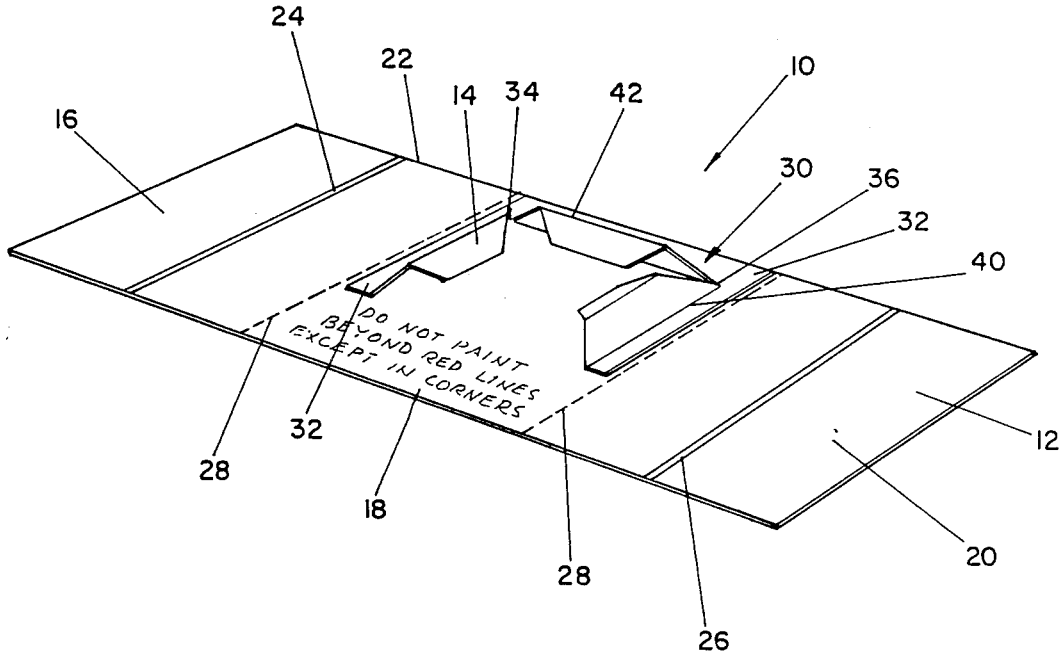
FIG. 2 shows the embodiment of FIG. 1 open for use with its paint vessel holder erected.
Figure 3:
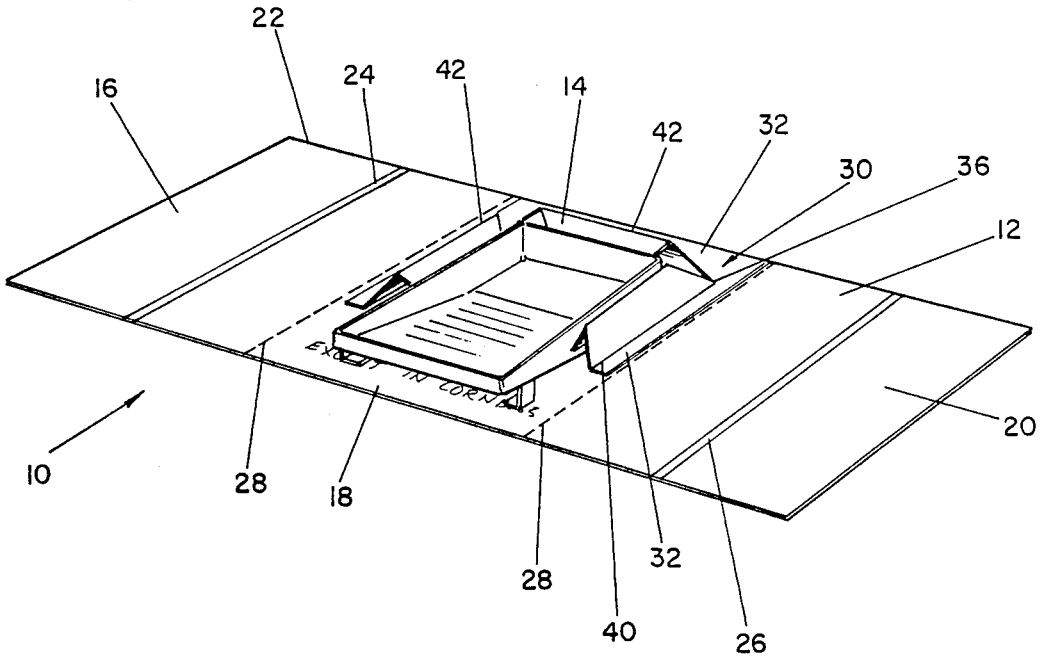
FIG. 3 depicts the embodiment of FIGS. 1 and 2 open for use with its paint vessel holder erected and a paint tray disposed therein.
Figure 4:
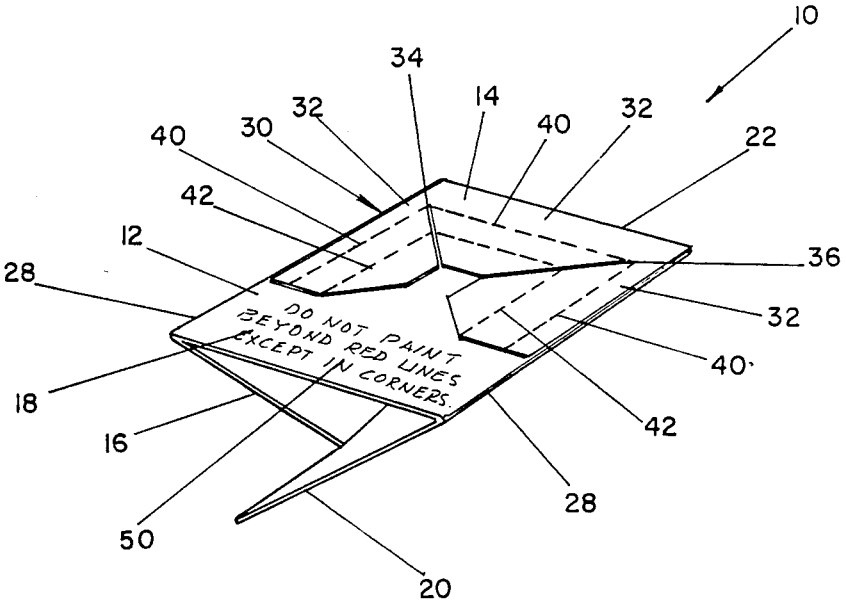
FIG. 4 shows the preferred embodiment partially folded in preparation for storage or disposal.

Reference is now made to FIGS. 1–4 which illustrate a preferred embodiment of the invention. As seen therein a foldable paint splatter board with collapsible paint vessel apparatus 10 comprises a covering structure 12 for protecting a surface such as a floor or carpet from paint splatter and a collapsible and erectable paint vessel holder 14. The covering structure 12 in the preferred embodiment comprises three portions, a left portion 16, a center portion 18 and a right portion 20. The preferred embodiment is in its open for use position in FIGS. 1–3 and partially folded for purpose of clarity of illustration in FIG. 4. The prefered embodiment is generally rectangular and has a substantially straight wall abutting edge 22 common to all three portions. In use, edge 22 is placed immediately adjacent to and preferably abutting a wall to be painted. The invention is not limited to having a straight abutting edge and modifications thereto can be made to accommodate curving walls, square and unsquare corners, and the like. Similarly, an apparatus in accordance with the invention can be folded for storage or otherwise when not in use along a single seam (in half), or along three or more parallel or nonparallel seams, such as seams 28 of the preferred embodiment. The folding seams can be perpendicular and intersecting if desired. In accordance with the invention, a protective apparatus is foldable into a relatively more compact configuration when not in use for storage and sales packaging, than it is when open for use.

Likewise, although the preferred embodiment is shown to be generally rectangular in shape, other shapes such as squares, semi-circles, truncated triangles, and other symmetric and non-symmetric shapes can be used in practicing the invention. Preferably, the shape utilized will fold into a neat and readily storable configuration along one or more seams. The seams upon which it is folded can be prefolded, indented, or otherwise treated to fold thereon, or simply marked for folding, as desired by a user or seller.

The preferred embodiment is constructible from corrugated paperboard, cardboard, sheet plastic, wood and the like. The material from which it is constructed is preferably at least semi-rigid, so that the apparatus retains its coverage when in use. Thus, a flexible sheet of plastic could be used, if desired, although the corners thereof could roll if not appropriately secured. Nonetheless, a suitably stiff, semi-rigid or rigid sheet composition, such as the above-mentioned exemplary materials provide, is preferred for use in carrying out the desideratum of the invention. The material can be inflammable or flammable and treated for flammability.

Boundary marking indicia 24 and 26, which in the preferred embodiment comprise stripes of a color contrasting with the color of covering structure 12, are positioned perpendicular to edge 22. The purpose of the boundary marking indicia is to alert a user to confine his or her painting to the portion of the wall being painted which is positioned over the region between the boundary marking indicia in order to insure, with a high degree of probability, that any paint splatters will fall onto the covering structure 12. Thus, a painter is alerted that painting beyond the boundary marking indicia 24 and 26, could lead to paint splatters beyond the range of coverage of the protective apparatus. The boundary marking indicia are a significant and novel feature of the invention and effectively minimize the possibility of a cautious user splattering the covered surface with paint. As used throughout the specification and claims, the term "paint" includes any type of surface coating which might fall or splatter on a surface to be protected.

Another novel feature of the invention is the erectable and collapsible paint vessel holder 30 which comprises a U-shaped flat element disposed on the covering structure 12. In the preferred embodiment, holder 30 is designed to hold a paint tray 32, but it could be sized and shaped to hold a paint can or other paint holding vessel. Vesel holder 30 is affixed to center portion 18 in the preferred embodiment by an adhesive, but it could be taped, stapled or otherwise suitably permanently or removably fastened thereto. Indeed, several sizes or types of vessel holder can be made available and one of the desired size or type mounted prior to use. Thus, one covering structure 12 can be used with various removably affixable holders 30 to accommodate paint trays and cans of various sizes and shapes.

The preferred U-shaped holder 30 embodiment, adhered to center portion 18 about its outside edge region 32, is slotted into corners 34 and 36 and foldable along longitudinal lines 40 and 42 disposed on the base and arms of the U-shaped holder 30. Seams 40 and 42 can be marked, indented or otherwise treated as stated hereinbefore with reference to folding seams 28. U-shaped paint vessel holder 30 folds on seams 40 and 42 to erect an inverted-V cross section vessel holder having three sides. In the preferred embodiment, the sides are sufficiently springy to exert sufficient force upon a contained vessel to frictionally hold it in place. Holder 30 erects into its raised position and collapses repeatedly for multiple uses, if desired. Thus the apparatus 10 can be repeatedly used until it wears out or acquires excessive paint splattering.

In use, the apparatus 10 is moved along a wall after each boundary marked section of the wall is painted and the adjoining unpainted section of the wall is painted within the confines of the boundary marking indicia 24 and 26.

Instructional indicia 50, alerting a user to the purpose of the boundary indicia, can be provided. Such indicia 50 would indicate to a user to confine brush or roller use to between the lines or boundary marking indicia 24 and 26.

The invention has been described in detail with particular reference to a preferred embodiment thereof, but it will be understood that variations and modifications can be effected within the scope of the invention.

What is claimed is:

1. A foldable paint splatter board with collapsible paint vessel holder comprising:

means for protecting a surface from paint splatter, said means comprising an at least semi-rigid surface covering and protecting element, said element comprising an edge engageable with the base of a vertical structure to be painted, said element being foldable on at least one preselected seam into a relatively more compact configuration when not in use; and means for retaining a paint vessel disposed on said element.

2. The invention of claim 1 wherein said element is foldable on at least two selected seams.

3. The invention of claim 1 wherein said vertical structure engaging edge is essentially straight to engage the base of a wall.

4. The invention of claim 3 wherein said surface protecting means comprises spaced boundary marking indicia thereon, said spaced indicia being viewable by a user, and positioned on said means to establish safe painting boundaries to alert a user to confine painting to the region between said spaced indicia whereby said means, with a high probability, will protect the surface covered thereby from splatter.

5. The invention of claim 4 wherein said indicia comprise stripes extending substantially perpendicular from said wall engaging edge.

6. The invention of claim 1 wherein said element is generally rectangular.

7. The invention of claim 1 wherein said paint vessel retaining means comprises means for holding a paint tray.

8. The invention of claim 1 wherein said paint vessel retaining means comprises means for holding a paint can.

9. The invention of claim 1 wherein said paint vessel holding means comprises means for holding various sizes and shapes of paint vessels.

10. The invention of claim 1 wherein said paint vessel holding means comprises means erectable into a raised position for use and collapsible into a flat position for storage.

11. The invention of claim 10 wherein said erectable and collapsible means comprises a generally U-shaped flat element foldable into a U-shaped raised position to provide a U-shaped paint vessel retaining structure.

12. The invention of claim 11 wherein said U-shaped paint vessel retaining structure comprises means for frictionally engaging a paint vessel disposed therein.

13. The invention of claim 1 wherein said surface protecting means comprises corrugated paper or cardboard.

14. A foldable paint splatter board with collapsible paint vessel holder comprising:

means for protecting a surface from paint splatter, said means comprising an at least semi-rigid generally rectangular surface covering and protecting element, said element comprising a substantially straight edge engageable with the base of a wall to be painted, said element being divided into generally equal portions by at least one preselected seam whereby said element can be folded thereon into a relatively compact unit when not in use; and erectable and collapsible means affixed on said element for retaining a paint vessel.

15. The invention of claim 14 wherein said surface protecting means comprises spaced bondary marking indicia thereon, said spaced indicia being viewable by a user, and positioned on said means to establish safe painting boundaries to alert a user to confine painting to the region between said spaced indicia whereby said means, with a high probability, will protect the surface covered thereby from splatter.

16. The invention of claim 15 wherein said protecting means comprises a first color and said indicia comprise stripes of a second color contrasting with said first color extending substantially perpendicularly from said wall engaging edge.

17. The invention of claim 14 wherein said erectable and collapsible means comprises a generally U-shaped flat element foldable into a U-shaped raised position having an inverted-V cross section to provide a U-shaped paint vessel retaining structure for disposing therein various sizes and shapes of paint vessels.

18. The invention of claim 17 wherein said U-shaped paint vessel retaining structure comprises sufficient springiness, when erected, to frictionally engage the vessel disposed therein.

19. A foldable paint splatter board with collapsible paint vessel holder comprising:

means for protecting a surface from paint splatter, said means comprising an at lest semi-rigid generally rectangular surface covering and protecting element, said element comprising a substantially straight edge engageable with the base of a wall to be painted, said element being divided into generally equal left, central and right portions by at least two preselected seams disposed thereacross perpendicular to said wall engaging edge, whereby said element can be folded thereon into a relatively compact unit when not in use; and erectable and collapsible means for retaining a paint vessel affixed on said central portion of said element.

20. The invention of claim 19 wherein said surface protecting means comprises spaced boundary marking indicia disposed on said left and right portions thereof, said spaced indicia being viewable by a user, and positioned on said portions to establish safe painting boundaries to alert a user to confine painting to the region between said spaced indicia whereby said surface protecting means, with a high probability, will protect the surface covered thereby from splatter.

21. The invention of claim 20 wherein said boundary marking indicia comprise stripes extending substantially perpendicular from said wall engaging edge.

22. The invention of claim 19 herein said erectable and collapsible means comprises a generally U-shaped somewhat rigid flat element, slotted at its corners and foldable into its erected position on predetermined longitudinal lines along the arms and base of the U into a U-shaped raised position having an inverted-V cross section to provide a U-shaped paint vessel retaining structure for disposing therein various sizes and shapes of paint vessels.

23. The invention of claim 22 wherein said U-shaped paint vessel retaining structure comprises sufficient springiness, when folding into its erected position along said longitudinal lines, to cause said vessel retaining structure to effectively hold the vessel disposed therein.

* * * * *